United States Patent [19]

Gordbegli et al.

[11] Patent Number: 4,501,232

[45] Date of Patent: Feb. 26, 1985

[54] POOL OR SPA WATER HEATER

[75] Inventors: Manochehr Gordbegli, Santa Ana; Sangchol An, Rolling Heights, both of Calif.

[73] Assignee: Purex Pool Products, Inc., Lakewood, Calif.

[21] Appl. No.: 538,550

[22] Filed: Oct. 3, 1983

[51] Int. Cl.[3] ..... F22B 15/00; F22B 25/00

[52] U.S. Cl. ..... 122/235 C; 122/367 C; 122/DIG. 13; 126/344; 126/350 R; 165/177; 165/185; 237/8 C

[58] Field of Search ..... 122/367 C, DIG. 13, 122/235 C; 237/8 C; 165/185, 177; 138/143; 126/344, 350 R

[56] References Cited

U.S. PATENT DOCUMENTS

| | | | |
|---|---|---|---|
| 2,476,666 | 7/1949 | Keller | 165/177 X |
| 3,134,366 | 5/1964 | Miller | 237/8 C |
| 3,741,169 | 6/1973 | Johnson | 122/367 C |
| 3,800,748 | 4/1974 | Schindler et al. | 122/367 C |
| 4,023,557 | 5/1977 | Thorne et al. | 138/143 X |
| 4,031,862 | 6/1977 | Smith | 122/DIG. 13 |
| 4,054,174 | 10/1977 | Haller | 122/DIG. 13 |
| 4,300,275 | 11/1981 | McLaughlin | 138/143 X |

*Primary Examiner*—Edward G. Favors

*Attorney, Agent, or Firm*—William W. Haefliger

[57] ABSTRACT

A pool or spa water heater comprises:

(a) a housing containing a combustion chamber, (b) gas burner means associated with the housing to produce hot products of combustion rising in said chamber, (c) a heat exchanger associated with said chamber in the path of said products of combustion to transfer heat to water flowing through said exchanger, (d) said exchanger including inner and outer metal tubes for transferring heat from the outer to the inner tubes and then to water flowing in the inner tube or tubes, said tubes having metal to metal contact, (e) whereby condensation of moisture from said products of combustion on exposed surfaces carried by the outer tubes is reduced.

13 Claims, 6 Drawing Figures

POOL OR SPA WATER HEATER

BACKGROUND OF THE INVENTION

This invention relates generally to liquid heaters, as for example water heaters, and more particularly concerns improvements in heaters wherein heat exchangers receive heat from hot products of combustion.

A constant problem associated with the operation of such heaters is that of unwanted condensation of moisture formed by the combustion process. Such condensation typically occurs on the heat exchanger tubes or fins due to their cooling by the liquid or water flowing in the tubes. To prevent such condensation, the liquid flow rate must be reduced to objectionably low level and the flue gas must be kept at objectionably high temperatures, all of which reduces operating efficiencies, and causes liming of tubes, and heat exchanger burn-out. Other problems have to do with difficulties in obtaining efficient housing and header design.

SUMMARY OF THE INVENTION

It is a major object of the invention to provide solution to the above problems. Basically, the improved liquid heater as for example is exemplified in a pool or spa waste heater comprises:

(a) a housing containing a combustion chamber, (b) gas burner means associated with the housing to produce hot products of combustion rising in said chamber, (c) a heat exchanger associated with said chamber in the path of said products of combustion to transfer heat to water flowing through the exchanger, (d) the exchanger including inner and outer metal tubes and in between material for transferring heat from the outer to the inner tubes and then water flowing in the inner tube or tubes, (e) whereby condensation of moisture from said products of combustion on exposed surfaces carried by the outer tubes is reduced, and liming of inner tubes is minimized or eliminated due to lower inner tube temperatures.

As will appear, the tubes may be circular or non-circular; and the inner tube outer surface may have random intimate contact with the outer tube bore, as results from forcing the inner tube endwise into the outer tube so as to have surface-to-surface engagement; the tubes may consist of copper or copper alloy (as for example brass); and the tubes may extend in pairs across the upper interior of the combustion space, as will be described.

A further aspect of the invention concerns the provision of a metallic housing wall facing the combustion chamber, and ducting in said metal wall in communication with the inner tubes of said two parallel stretches to pass water through said ducting for cooling said wall. Heater controls may therefore be located at the cool outer side of that wall. Additional further aspects include the provision of refractory panels facing the sides of the combustion chamber, and air gaps between casing walls and the panels, for cooling air flow upwardly; and an integral boss in an inlet liquid heater, to receive a thermostat in a drilled opening in that boss.

These and other objects and advantages of the invention, as well as the details of an illustrative embodiment, will be more fully understood from the following description and drawings, in which:

DRAWING DESCRIPTION

DETAILED DESCRIPTION

Figure 1:
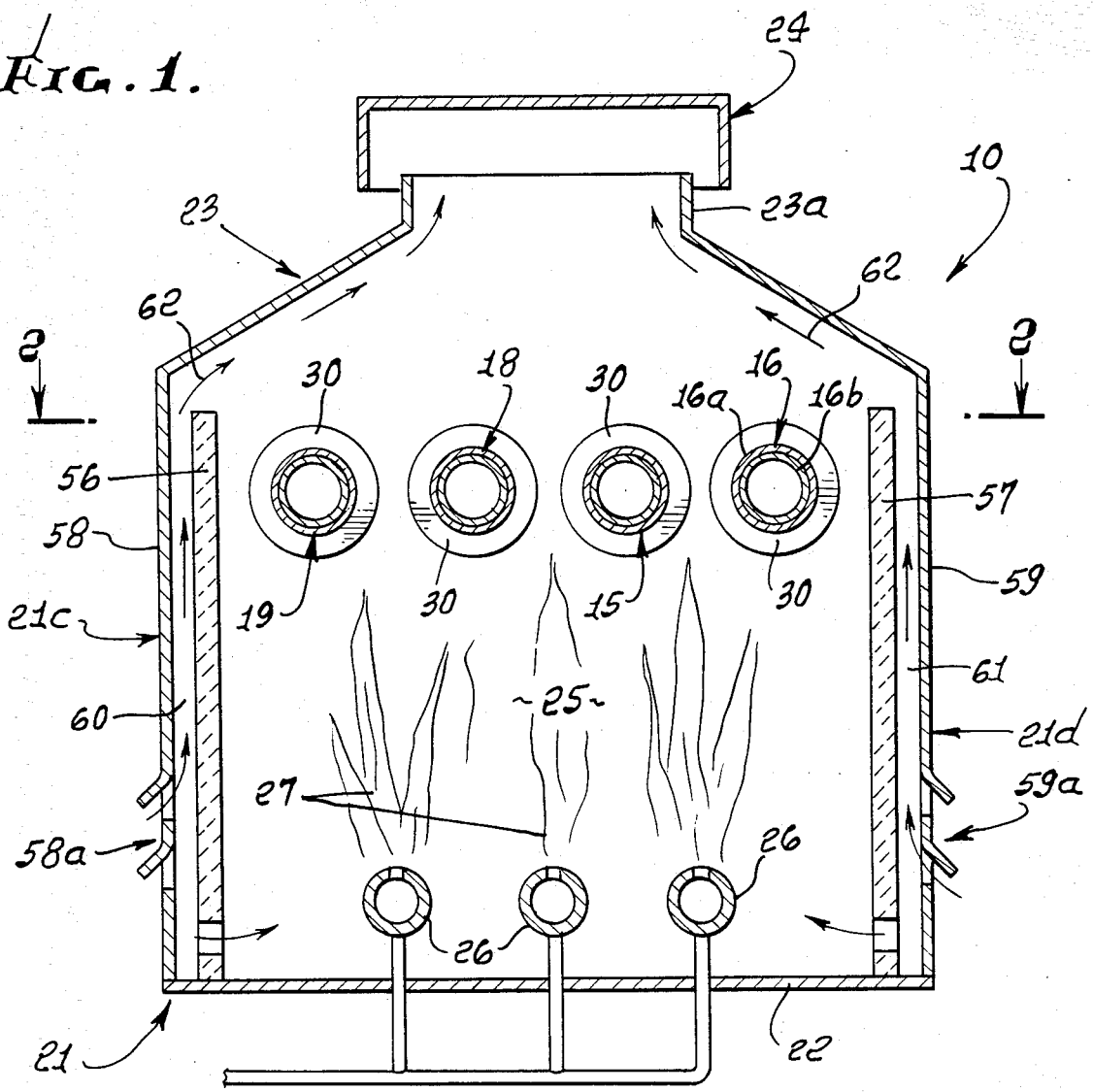
FIG. 1 is an elevation taken in section through apparatus incorporating the invention, as for example on lines 1—1 of FIG. 2.
Figure 3:
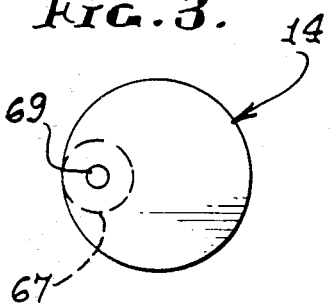
FIG. 3 is an elevation on lines 3—3 of FIG. 2.

In the drawings, the illustrated pool water heater 10 is shown as receiving cooler water via line 11 from the pool or spa 12, and as delivering warmer water via line 13 to the pool or spa. The heater may include a header 14 to which lines 11 and 13 are connected, as appears in FIG. 2. The header may include an inlet chamber 14*a* via which water flows to multiple tubing stretches as at 15 and 16 for flow therein in parallel directions indicated by arrows 17, and an outlet chamber 14*b* via which water is discharged from two tubing stretches 18 and 19, after flow therein in parallel directions indicated by arrows 20. Direction 20 may be opposite to direction 17.

The heater also includes a housing 21 defined by upright end walls 21*a* and 21*b*, and upright side walls 21*c* and 21*d*. The housing may also include bottom wall 22, and top wall 23 which converges upwardly to form a discharge stack 23*a* for combustion products. A stack cover 24 may be employed.

As shown in FIG. 1, the housing contains or forms a combustion chamber 25, and gas burners 26 may be located in the lower interior of that chamber to discharge the combustible gas and air mixture upwardly, for flame production at 27. Hot products of combustion rise in chamber and contact the tubing stretches 15, 16, 18 and 19 for heating the cooler water flowing therein. Such tubing stretches preferably have fins 30 integral with outer metal tubes 15*a*, 16*a*, 18*a* and 19*a*, for enchancing heat transfer to the fins and thence via the tubes to the flowing water. The fins are located along the tubing lengths.

In accordance with an important aspect of the inventon, the heat exchanger stretches 15, 16, 18 and 19 also include inner tubes 15*b*, 16*b*, 18*b* and 19*b* as well as the outer tubes 15*a*, 16*a*, 18*a* and 19*a* as described, for transferring heat to the water flowing within the inner tubes. Both inner and outer tubes may be concentric and metallic (copper or copper alloy, for example), and the inner tube is typically pushed or forced into the outer tube to have (random) outer surface contact with the outer tube bore. As a result, it is found that the heat transfer characteristics of the assembly are favorably altered, so that the outer tubes and fins can be operated at higher and inner tubes at lower temperatures, and the water flow rate through the tubes can be increased or decreased, all without increasing the condensation of water on the heat exchanger surfaces, from the gaseous products of combustion and without increasing liming (lime formation). In other words, the efficiency of the exchanger is not limited to as great a degree by condensation, as compared with prior exchangers which lacked the dual tube construction, so that heat exchanger efficiencies can now be increased to typically between 80 and 90%, as compared with prior efficiencies of typically 75–78%. Further, satisfactorily high efficiencies can be obtained under operating conditions characterized by substantially no surface condensations. The reduction of inner surface temperature will minimize possibility of liming that usually will form on hot surfaces.

Figure 5:
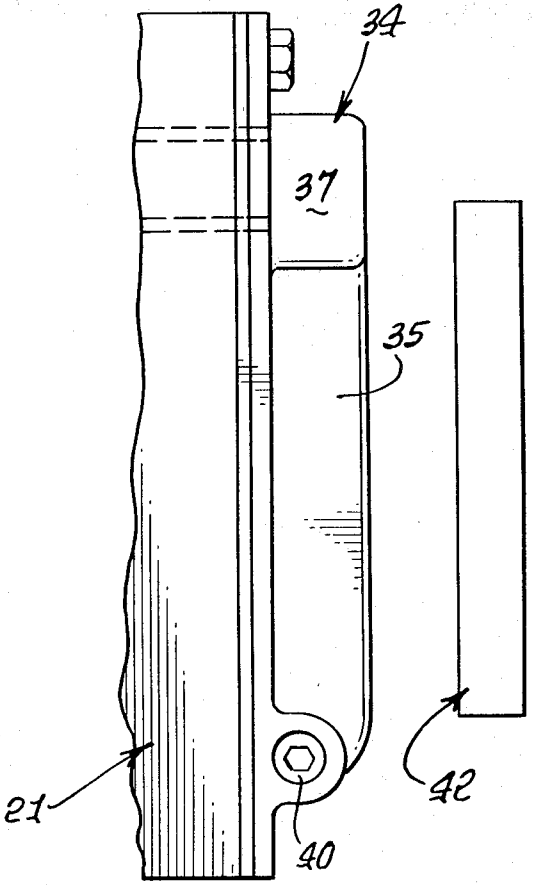
FIG. 5 is an end elevation taken on lines 5—5 of FIG. 4.
Figure 4:
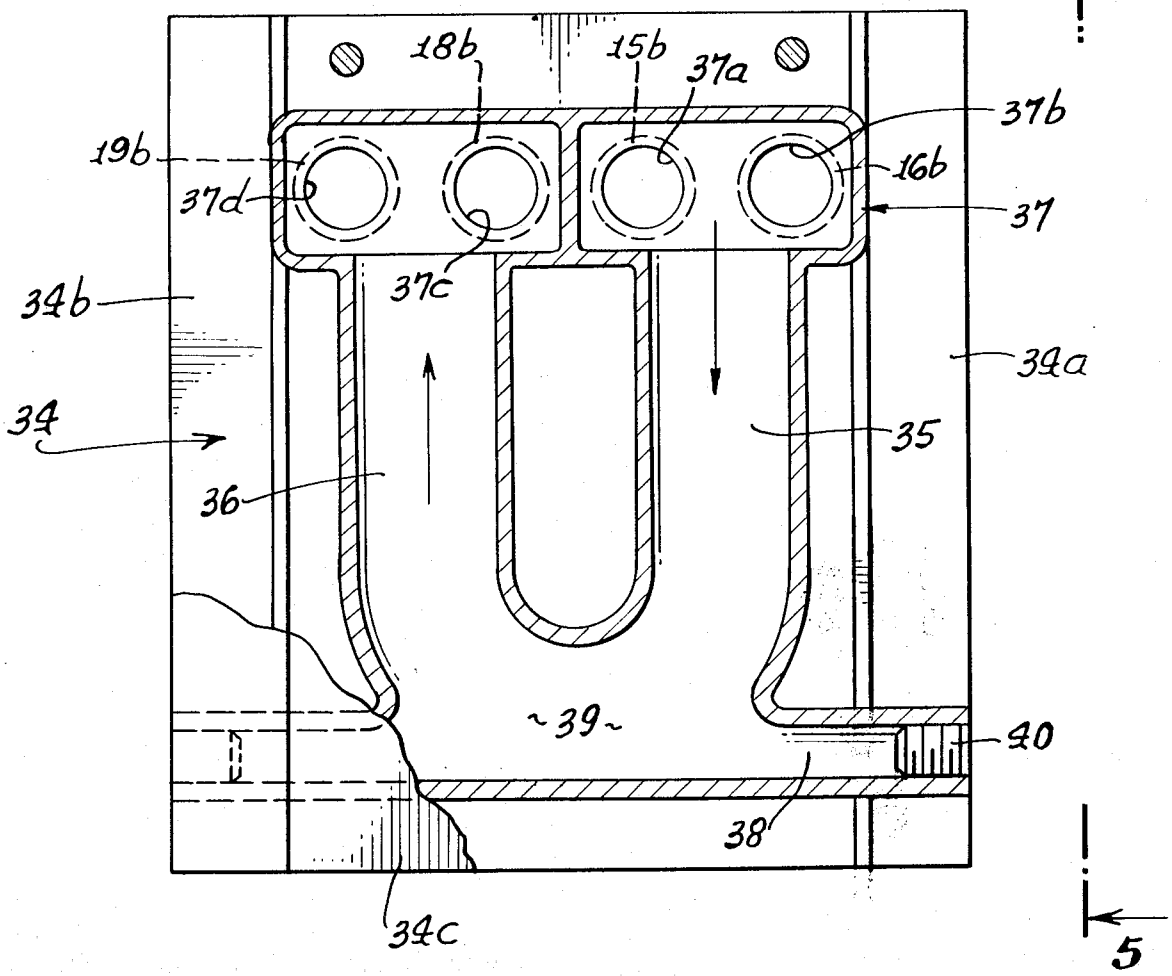
FIG. 4 is a frontal view of the end wall plate, taken on lines 4—4 of FIG. 2.

A further aspect of the invention concerns the provision of a housing wall facing the combustion chamber and consisting of metal, such as brass, copper or copper alloy. See for example wall 34 in FIGS. 2, 4 and 5. That wall contains ducting in communication with the inner tubes 15*b*, 16*b*, 18*b* and 19*b*, to pass water through that ducting for cooling the wall facing the combustion zone. Since the wall is metallic, the heat transferred from the combustion zone to the wall flows rapidly to the water circulating through the ducting. The latter is shown in FIG. 4 as U-shaped, with vertical branch 35 receiving water from tubes 15*b* and 16*b*, for delivery to vertical branch 36 which delivers water to tubes 18*b* and 19*b*. Wall flanges 34*a*, 34*b* and 34*c* project laterally from the duct regions. A header 37 integral with wall 34 has inlets 37*a* and 37*b* in registration with tubes 15*b*, 16*b*, and outlets 37*c* and 37*d* in registration with tubes 18*b* and 19*b*. Inlets 37*a* and 37*b* pass water to duct 35, and duct 36 passes water to outlets 37*c* and 37*d*. A drain passage 38 communicates with the U-shaped bottom extent 39 of the ducting, and threaded plugs 40 may be removed from that passage for draining the ducts of sediment, when desired.

Figure 2:
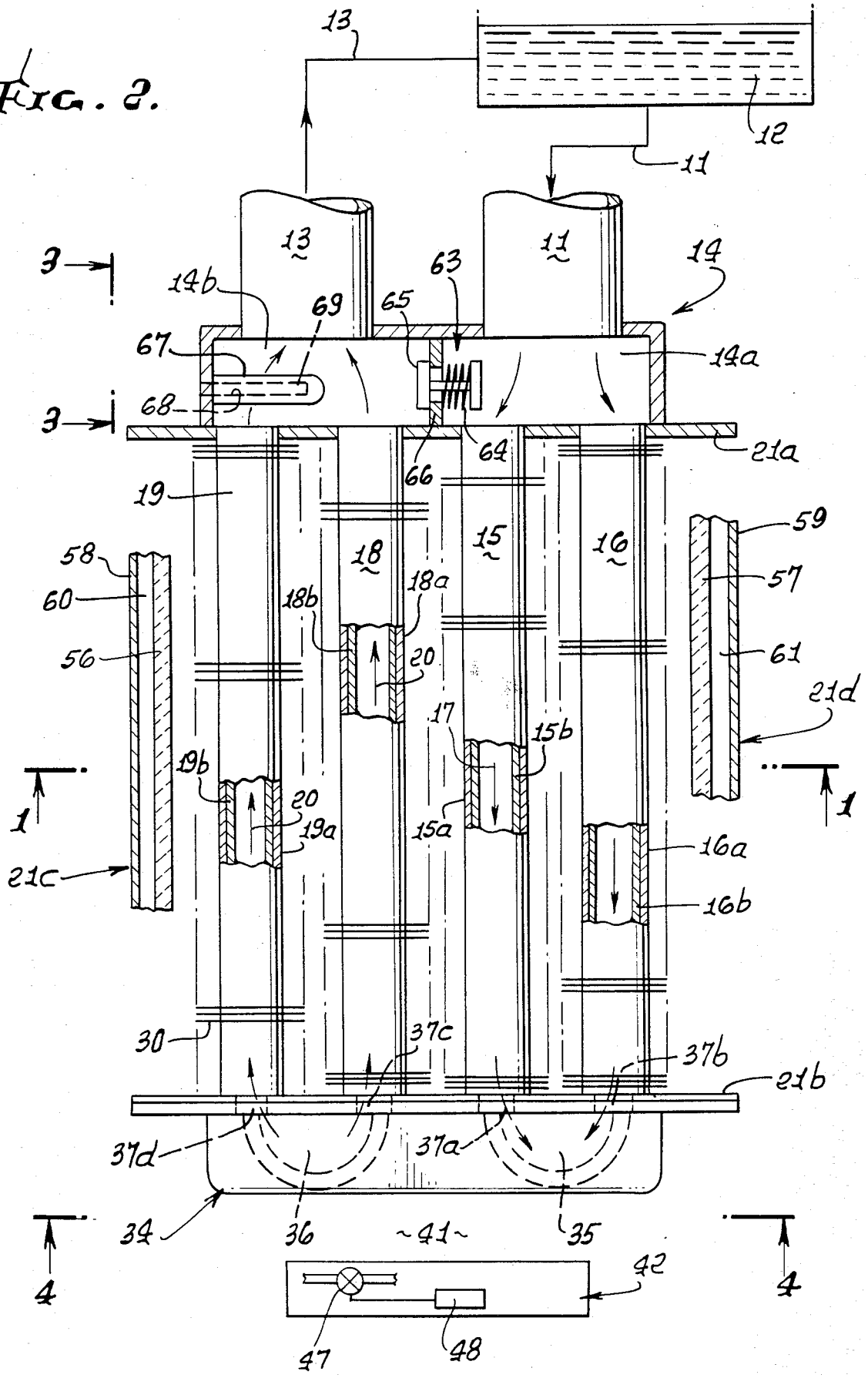
FIG. 2 is a plan view taken on lines 2—2 of FIG. 1.

Heater controls are located in the cool zone 41 frontward of the wall 34. Such controls indicated generally at 42 may for example include an automatic control or controls for gas flow and for pilot operation. FIG. 2 schematically shows a gas flow valve 47, and control 48 therefor. Other controls may be provided, and are kept cool by their locations in front of plate 34.

The housing walls 21*c* and 21*d* include refractory panels 56 and 57 located at opposide sides of the combustion zone, to block heat transfer therefrom. The walls 21*c* and 21*d* further include metal outer casing walls 58 and 59 spaced outwardly from the refractory panels to form gaps 60 and 61 which extend upwardly for passage of air in cooling relation with the refractory panels. Casing walls 58 and 59 may be louvered as at 58*a* and 59*a* to admit air to the gaps. Air also is drawn upwardly by the draft created by upward flow of combustion products in the stack, and the cooling air passes along the insides of the housing upper walls 23, as shown by arrows 62.

Referring to FIG. 2, the header 14 is shown as incorporating a by-pass valve 63 operating to pass water in chamber 14*a* to chamber 14*b* in the event the pressure rises above a pre-determined limit. Valve 63 may be a check valve, spring urged at 64 toward closed position, with stopper 65 engaging seat 66. The stopper moves to the left, away from seat 66 when the pressure exceeds the limit. Also shown is a boss 67 integral with the cast header metal and exposed to chamber 14*b*. A drilled opening 68 in the boss removably receives a thermostat unit 69. The latter may therefore be easily replaced. It may control heating of the unit, as by connection with electronic controller 48, so as to increase the gas flow rate if the discharge water temperature drops too low, and vice versa.

Figure 6:
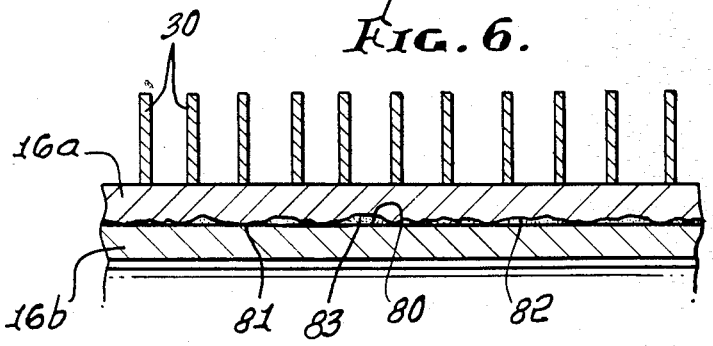
FIG. 6 is an enlarged section showing inner and outer tube wall interfit.

FIG. 6 shows, in enlarged form, the inner tube 16*b* having a relatively smooth outer surface 80 contacting innermost surface portions 81 of the less smooth bore 82 of the outer tube 16*a*. Heat transfer material 83 may be provided in the gaps between surfaces 80 and 82, and may consist of a lubricant such as silicone grease or molybdenum disulfide that aids tube assembly. The gaps and the use of the heat transfer material enhance the operation of the outer tubes at higher temperature and the inner tubes at lower temperature. In certain cases, the heat transfer material need not fill all the gaps, or may be eliminated. The sizes of the gaps are greatly exaggerated in FIG. 6.

We claim:

1. In a pool or spa water heater, the combination comprising:

(a) a housing containing a combustion chamber, (b) gas burner means associated with the housing to produce hot products of combustion rising in said chamber, (c) a heat exchanger associated with said chamber in the path of said products of combustion to transfer heat to water flowing through said exchanger, (d) said exchanger including inner and outer metal tubes, said outer tubes extending openly in the direct path of said hot products of combustion for transferring heat from the outer to the inner tubes and then to water flowing in the inner tube or tubes, said tubes having metal to metal contact, the outer tubes located about the inner tubes, (e) and means including sufficient non-metallic and flowable heat transfer material in gaps formed between the tubes and along their lengths for reducing condensation of moisture from said products of combustion on exposed surfaces carried by the outer tubes substantially below condensation levels that would exist in the absence of said means and inner tubes, the inner tube external surface having random contact with the outer tube bore.

2. The combination of claim 1 wherein said surfaces carried by the outer tubes include fins.

3. The combination of claim 1 wherein said inner and outer tubes extend across said combustion chamber in at least two parallel stretches within which the water flows in opposite directions.

4. The combination of claim 1 wherein said inner and outer tubes consist essentially of copper or copper alloy.

5. The combination of claim 3 wherein the housing has a wall facing said combustion chamber and consisting of metal, and ducting in said metal wall in communication with the inner tubes of said two parallel stretches to pass water through said ducting for cooling said wall.

6. The combination of claim 5 including a heater control or controls at the outer side of said metal wall.

7. The combination of claim 6 wherein said heater control or controls includes a gas flow control valve and an electronic control therefor.

8. The combination of claim 5 including a metallic header associated with said housing and having porting to pass inflow of pool or spa water to the inner tube of at least one of said stretches for flow therein, and to pass outflow of water from the inner tube of at least one other of said stretches for flow to the pool or spa.

9. The combination of claim 8 wherein the header includes a metallic boss exposed to water in the header, the boss containing a drilled opening, and a thermostat unit removably received in said drilled opening.

10. The combination of claim 8 including a by-pass valve in the header and characterized as operable to by-pass inflowing water to the outflowing water in response to an increase in pressure of inflow water above a predetermined limit.

11. The combination of claim 10 wherein said by-pass valve is a spring-urged check-valve.

12. The combination of claim 5 wherein the housing has at least one refractory panel facing the combustion chamber, and a metal outer casing wall spaced from the refractory panel at the outer side thereof, thereby to form an upwardly extending air gap therebetween for passage of air in cooling relation with the refractory panel.

13. The combination of claim 5 wherein the housing has two refractory panels facing the combustion chamber at opposite sides thereof, and vented metal outer casing walls spaced outwardly of the refractory panels thereby to form upwardly extending air gaps for passage of air upwardly in cooling relation with said refractory panels, and toward a stack located on the housing, the stack passing said products of combustion to the exterior and creating a draft tending to draw cooling air upwardly in said gaps.

* * * * *